US005889221A

United States Patent [19]

Dejima

[11] Patent Number: 5,889,221

[45] Date of Patent: Mar. 30, 1999

[54] STRINGED INSTRUMENTS HAVING IMPACT ABSORBER BETWEEN TOP AND BACK

[75] Inventor: Tatsuya Dejima, Hamura, Japan

[73] Assignee: Casio Computer Co., Ltd., Tokyo, Japan

[21] Appl. No.: 933,023

[22] Filed: Sep. 18, 1997

Related U.S. Application Data

[63] Continuation of Ser. No. 446,052, May 19, 1995, abandoned.

[30] Foreign Application Priority Data

May 30, 1994 [JP] Japan ..... 6-137849

[51] Int. Cl.[6] ..... G10D 3/00

[52] U.S. Cl. ..... 84/291; 84/267; 84/297 R

[58] Field of Search ..... 84/291, 293, 267, 84/297 R, 313

[56] References Cited

U.S. PATENT DOCUMENTS

| | | | |
|---|---|---|---|
| 3,357,291 | 12/1967 | Carmichael | 84/267 |
| 3,443,466 | 5/1969 | Brakewell | 84/291 |
| 3,821,475 | 6/1974 | McKechnie | 84/267 |
| 5,305,675 | 4/1994 | Lasner | 84/313 |
| 5,347,904 | 9/1994 | Lawrence | 84/291 |

FOREIGN PATENT DOCUMENTS

| | | |
|---|---|---|
| 58-52593 | 4/1983 | Japan . |

*Primary Examiner*—Cassandra C. Spyrou
*Attorney, Agent, or Firm*—Frishauf, Holtz, Goodman, Langer & Chick

[57] ABSTRACT

A stringed instrument has a body which is composed of a back case and a top case combined by screwing up screw receiving bosses of the back case to screw attaching bosses of the top case with a vibration absorber provided between a side wall of the back and a side wall of the top. Attached to the back case are string vibration parts such as a neck and a bridge base. The bridge base is exposed to the outside from an opening in the top case. Non-string vibration parts including a tape recorder and a speaker are attached to the top case. Thus, when string vibrations are transmitted from the back case to the top case, the central portion of the top of the top case becomes a loop where the vibration amplitude is maximum and the top vibrates greatly freely. Thus, according to the inventive stringed instrument, a musical sound of an increased volume with a warm tone quality containing sufficient overtones is obtained.

9 Claims, 16 Drawing Sheets

STRINGED INSTRUMENTS HAVING IMPACT ABSORBER BETWEEN TOP AND BACK

This application is a Continuation, of application Ser. No. 08/446,052, filed May 19, 1995 now abandoned.

BACKGROUND OF THE INVENTION

The present invention relates to stringed instruments such as electric guitars and folk guitars.

There are stringed instruments which have a hollow body generally composed of a pair of substantially parallel top and back and a side which extends between the top and back along the periphery of the top and back so as to form a hollow in the body. Strings extend over the outer top whereas the outer back faces the player when the instrument is played. A neck is attached to the body between the top and back at a predetermined end of the body with the strings extending from a bridge attached at substantially the center of the top to a head provided at an opposite end of the body from the neck.

A stringed instrument having a hollow body causes the air within the hollow body to resonate with string vibrations to thereby generate a musical sound of a warm soft tone quality compared to a stringed instrument having a solid body without a hollow in its body. The features of the tone quality of a musical sound generated by a hollow-bodied stringed instrument are common to any of an acoustic stringed instrument which generates a musical sound due to only string vibrations and body resonance without electrical amplification and an electric stringed instrument which generates a musical sound by converting a string vibration to an electric signal and amplifying the electric signal. Even in the case of the electric stringed instrument, vibrations of its body return to its strings, so that not only the strings but also the structure of the body is a factor which characterizes the tone quality of the musical sound.

In the conventional hollow-bodied stringed instrument, a bridge is attached at the center of the top of the body which makes string vibrations rich in resonance to the string vibrations. Thus, the center of the body does not vibrate and forms a node of the vibrations of the top (where the vibration amplitude is minimum). Accordingly, the vibrations of the top are limited and monotonous and the vibration amplitude is limited. Thus, the number of overtone components added to the obtained musical sound is limited and hence the warmth of the tone quality of the musical sound is limited, undesirably.

If parts such as a tape recorder and a speaker providing an additional function are attached to the hollow body of the stringed instrument so as to have additional functions, many of the additional parts are generally vulnerable to vibrations and could malfunction owing to possible impact produced by touching the strings and the movement of the whole instrument caused by the player's move.

SUMMARY OF THE INVENTION

It is therefore a first object of the present invention to provide a stringed instrument having a simple structure to provide a musical sound of a warm tone quality including sufficient overtones.

In order to achieve this object, the present invention provides a stringed instrument comprising:

a hollow body comprising a top and a back and having a hollow therein; and string vibration part attached to any one of the top and back of the body and involved in string vibrations.

In another aspect, the present invention provides a stringed instrument comprising:

a body having an internal hollow formed by a top case and a back case; and string vibration part attached to one of the top and back cases and involved in string vibrations.

According to the inventive stringed instruments, the string vibration part including a bridge and a neck are attached to one of the back or back case and the top or top case of the body. Thus, if string vibrations are transmitted from one of the back or back case and the top or top case to the other, the other vibrates greatly with its center as a loop of the vibrations (where the vibration amplitude is maximum). Thus, the musical sound generated by the stringed instrument has a warm tone quality which contains sufficient overtones and the volume of the musical sound increases.

In still another aspect, the present invention provides a stringed instrument comprising:

a whole body which comprises an upper body and a lower body, the lower body having required rigidity;

a neck attached to the lower body; and a string extending with one end of the string supported by a string support provided on the lower body.

According to this inventive stringed instrument, the obtained musical sound has a warm tone quality containing sufficient overtones and the volume of the musical sound further increases like the earlier-described inventive instruments. Furthermore, since the back body has the required rigidity, a longer-sustaining musical sound is obtained. No reinforcements separate from the back body and resisting to the tension of the strings are required to be provided to thereby reduce the number of parts used and simplify the manufacturing process of the instrument.

It is a second object of the present invention to provide a stringed instrument where the parts vulnerable to possible vibrations are protected from vibrations and impact caused by playing the instrument.

In order to achieve this object, the present invention provides a stringed instrument having a recording/reproducing device on a body thereof, wherein the recording/reproducing device is provided at a position remote from the rotational center of the body in the performance of the stringed instrument.

By such construction, even when the body of the inventive stringed instrument is turned when played, the recording/reproducing device is not rotated by the turning of the instrument, but only makes substantially linear reciprocation to thereby operate well the recording/reproducing device vulnerable to the turning movement.

DETAILED DESCRIPTION OF THE PREFERRED EMBODIMENTS

First Embodiment

Referring to FIGS. 1–4, an electric guitar of a first embodiment according to the present invention will be described below.

Figure 1:
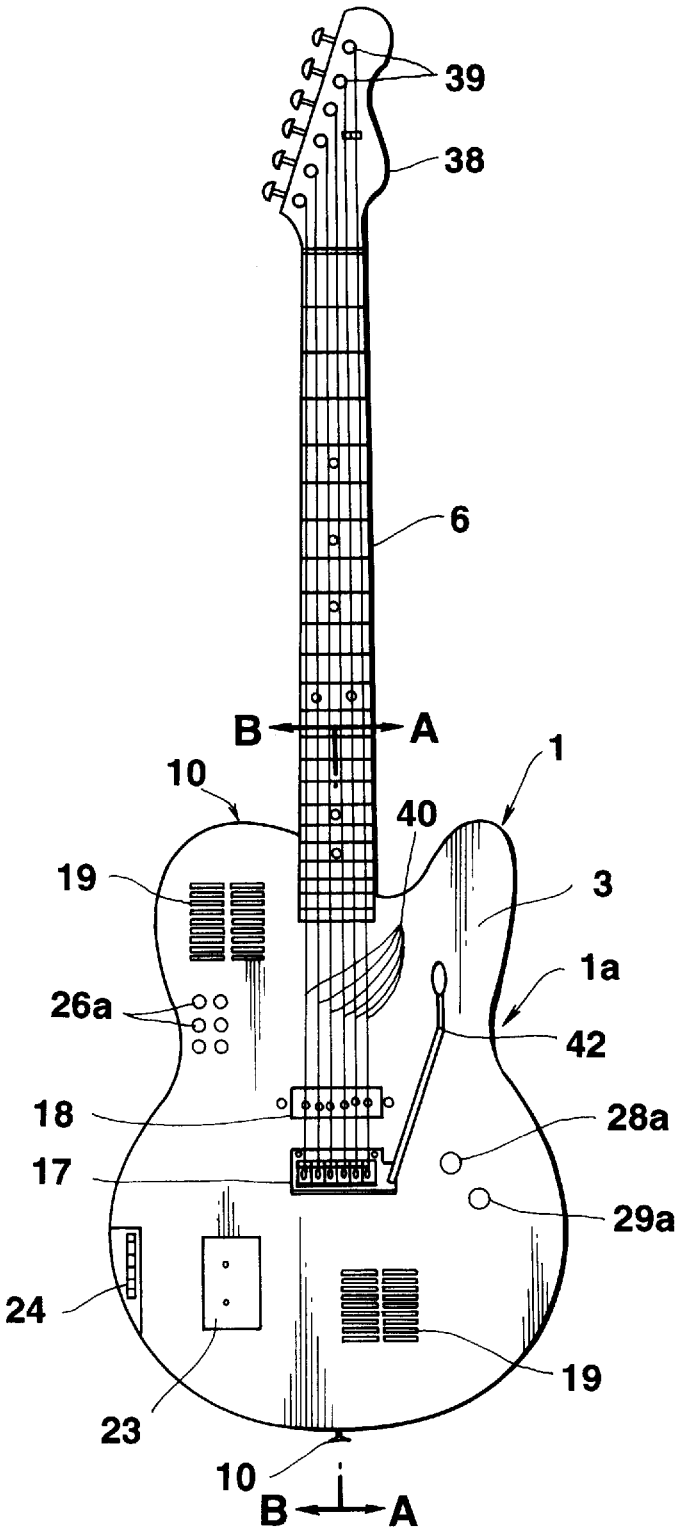
FIG. 1 is a front view of an electric guitar of a first embodiment of the present invention.
Figure 2:
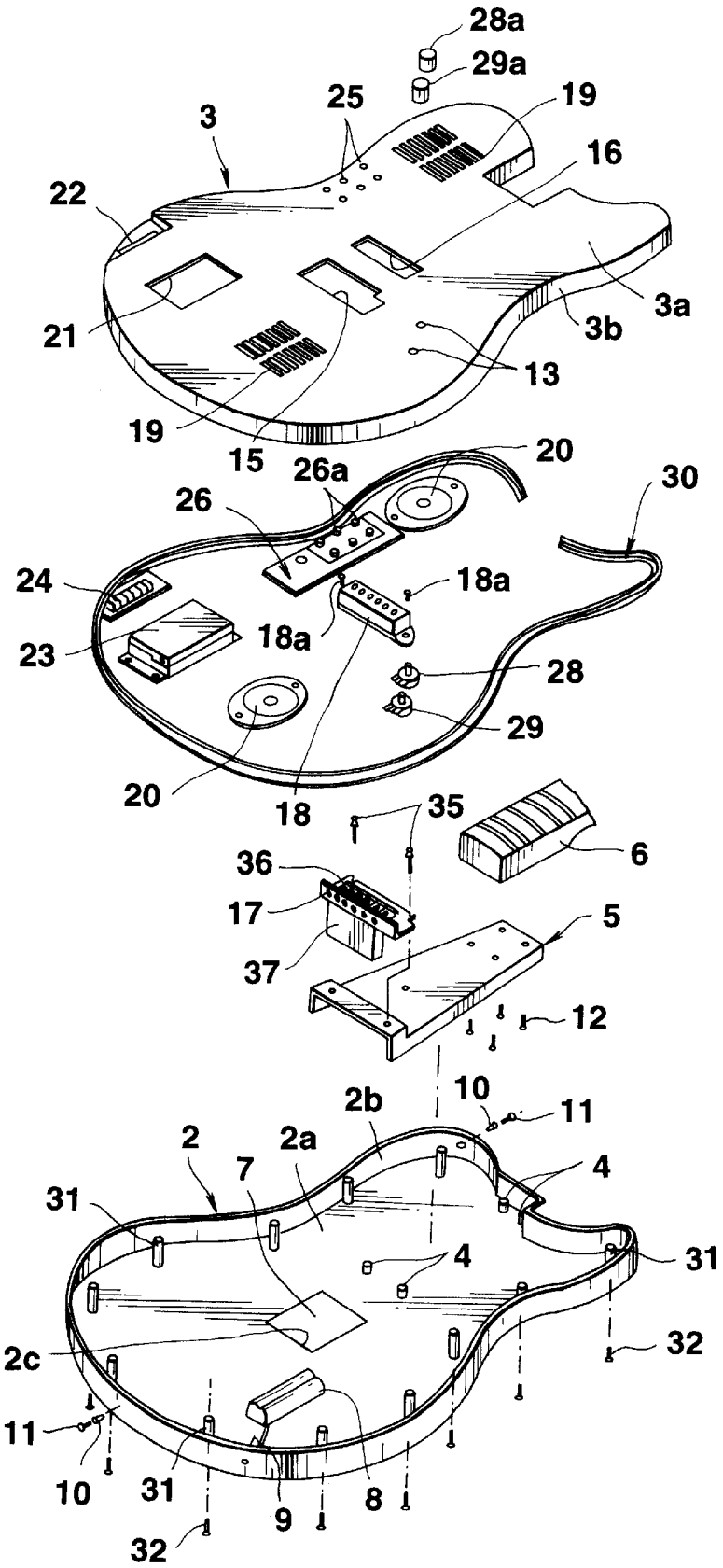
FIG. 2 is an exploded perspective view of an essential portion of the guitar of the first embodiment.
Figure 3:
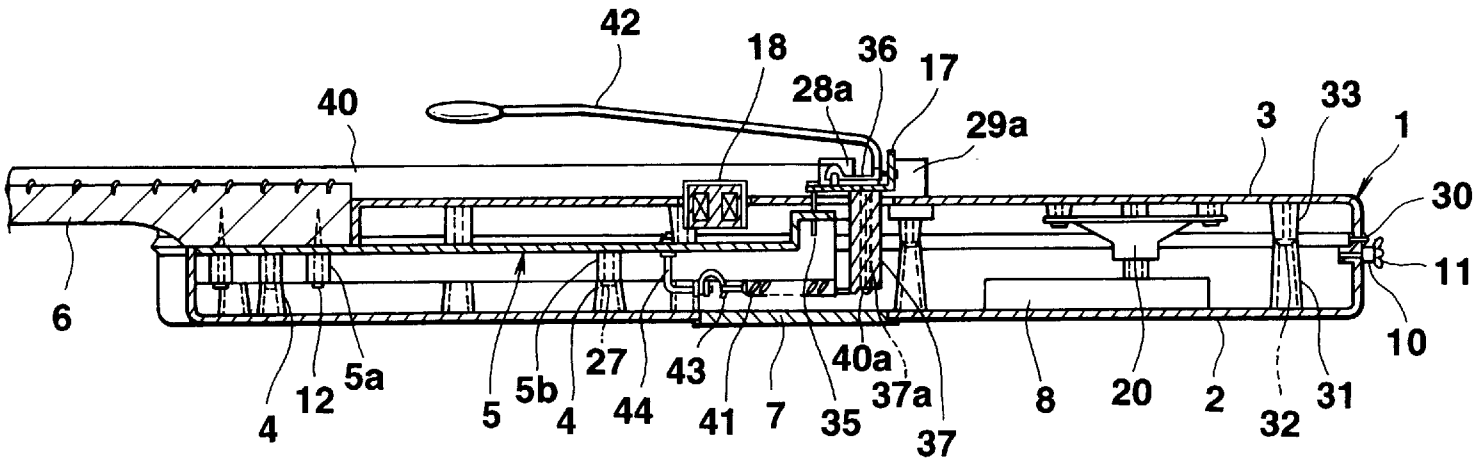
FIG. 3 is a cross-sectional view taken along the lines A—A of FIG. 1.

FIG. 1 is a front view of the electric guitar of the first embodiment. FIG. 2 is an exploded perspective view of an essential portion of the guitar. FIG. 3 is a cross-sectional view taken along the lines A—A of FIG. 1.

The electric guitar has a hollow body 1 which includes a back case 2 and a top case 3. As shown in FIG. 2, the back case 2 is composed of a synthetic resin molding which is made from a bottom 2*a* and a peripheral side 2*b* extending integrally along the periphery of the bottom 2*a*. Four upstanding attaching bosses 4 are provided at substantially the center and right-hand end of the bottom 2*a*. A reinforcement 5 is attached to the attaching bosses 4. The bottom 2*a* has an opening 2*c* at substantially the center thereof with an openable cover 7 being provided so as to cover the opening 2*c*. A cell receiver 8 and a jack 9 in which an external output plug (not shown) is inserted are provided on the bottom 2*a* at its lower left-hand position. Screw insertion bosses 31 are provided at appropriate intervals along the side 2*b* of the bottom 2*a*. Strap fixtures 10 are attached by screws 11 to the side 2*b* of the back case 2 at its left- and right-hand positions with a strap (not shown) which hangs the guitar from the player's shoulder being attached removably to the fixtures 10.

As shown in FIGS. 2 and 3, the reinforcement 5 is made of a material of high rigidity such as a rigid metal and has a substantial U-like cross-section. A neck 6 is attached to an upper right-hand end of the reinforcement 5 with four screws 12 inserted through four neck attaching bosses 5*a* provided below the reinforcement 5. A bridge base 17 is attached to an upper left-hand end surface of the reinforcement 5 with two attaching pins 35 so as to be movable vertically. Two attaching bosses 5*b* are provided at each of the right- and left-hand ends thereof on a lower surface of the reinforcement 5 (FIG. 3).

The back case 2 and the reinforcement 5 are attached integrally to each other by screws 27 screwed through the attaching bosses 4 from below the back case 2 into the corresponding attaching bosses 5*b* of the reinforcement 5.

As shown in FIG. 3, a bridge saddle 36 is provided on the bridge base 17 attached to the reinforcement 5. A tremolo block 37 is provided on a lower surface of the bridge base 17. Six strings 40 engaged at their ball ends 40*a* with a lower end of the tremolo block 37 extend vertically through holes 37*a* in the tremolo block 37 and thence through holes in the bridge base 17 and horizontally over an upper end of the bridge saddle 36 and the neck 6 to six pegs 39 provided at a head 38 of the neck 6. A coil spring 41 which counters the tension of the strings 40 through an L-like bolt 44 and a V-like fixture 43 is provided between the lower end of the tremolo block 37 and the reinforcement 5. A tremolo arm 42 is attached to the bridge base 17 and the tremolo block 37 to swing the bridge saddle 36, bridge base 17 and the tremolo block 37, using as a fulcrum a contact point between an attaching pin 35 and the bridge base 17 to thereby change the tone pitch. Thus, the bridge base 17, bridge saddle 36, tremolo block 37 and coil spring 41 correspond to string supports. The string support, neck 6, head 38 and pegs 39 and tremolo arm 42 correspond to string vibration parts, which are attached to the reinforcement 5, which is, in turn, attached to the back case 2.

As shown in FIG. 2, the top case 3 is composed of a synthetic resin molding which is made from a top 3*a* and a side 3*b* extending integrally along a lower periphery of the top 3*a*. A bridge opening 15 and a pick-up opening 16 are provided at substantially the center of the top 3*a*. The bridge base 17 is exposed to the outside through the bridge opening 5. A pick-up 18 which converts vibrations of the strings 40 to an electric signal and outputs the signal is screwed up through coil springs 18*a* in the pick-up opening 16 with part of the pick-up 18 extending upward through the top 3. Sound release holes 19 are provided at an upper right-hand position and a lower left-hand position on the top 3*a*. Speakers 20 are provided below the corresponding sound release holes 19. A tape recorder body 23 and tape recorder switches 24 are screwed up in a tape recorder opening 21 and a recorder switch fixture 22, respectively, provided at upper left-hand positions on the top 3*a*. A circuit board 26 on which elements having effect functions are provided is attached to a lower surface of the top 3*a* at its upper middle position. Push buttons 26*a* which each select and adjust an effect sound related to an effect function are inserted into corresponding push button holes 25 provided in the top 3*a*. A variable resister 28 which adjusts the volume of a musical sound and a variable resister 29 which cuts off a high pitch sound region to change the tone quality are attached in corresponding holes 13 in the top 3*a* at its lower middle positions with operation knobs 28*a*, 29*a* which extend upward through the top case 3 being attached to the respective resistors 28 and 29. Screw receiving bosses 33 are provided at appropriate intervals along the peripheral side 3*b* of the lower surface of the top 3*a* (FIG. 3). The tape recorder body 23, speaker 20 and circuit board 26 are parts vulnerable to vibrations and which should be isolated from string vibrations.

Figure 4:
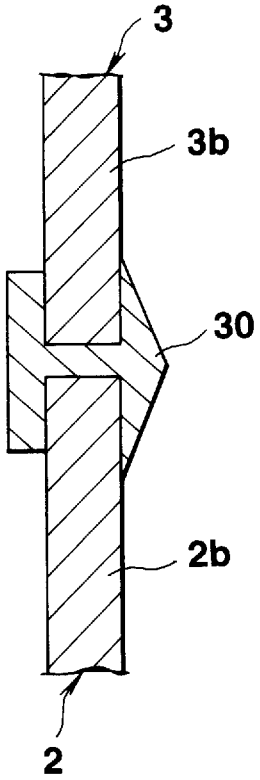
FIG. 4 is an enlarged view of a structure where a resilient packing 30 of the guitar of the first embodiment shown in FIG. 3 is attached.

As shown in FIGS. 2 and 3, the back and top case sides 2*b* and 3*b* are aligned with each other with a resilient packing 30, for example, of rubber disposed therebetween and tightened integrally with screws 32 screwed through the screw insertion bosses 31 from below the back case 2 into the screw receiving bosses 33 provided on the top case 3. In this case, as shown in FIG. 4, the packing 30 takes the form of a strip having a substantially H-like cross section with the back case side 2*b* and the top case side 3*b* being fitted at their upper and lower ends, respectively, into the corresponding grooves of the H-like strip.

In this guitar, string supports including the bridge base 17, and the string vibration parts including the neck 6, head 38, pegs 39 and tremolo arm 42 are attached to the back case 2 of the body 1. Thus, when vibrations of the strings 40 are transmitted from the back case 2 to the top case 3 through the screw insertion bosses 31, screws 32 and screw receiving bosses 33, the central portion of the top case 3 becomes a loop of the vibrations where the vibrating amplitudes are maximum to thereby cause the top case 3 to vibrate freely. Thus, those vibrations influence the vibrations of the strings 40 to cause the string vibrations to contain sufficient overtone components to thereby provide a beautiful musical sound including sufficient overtone components. Since the top case 3 vibrates greatly compared to the conventional structure, the amplitude of the string vibrations increases to thereby provide a musical sound of a larger volume.

In this case, since the string vibration parts are attached through the reinforcement 5 to the back case 2, string vibration parts such as the bridge base 17 and neck 6 are attached fixedly to the back case 2 to thereby prevent the tension of the strings 40 from deforming the body 1.

Since non-string vibration parts such as the tape recorder body 23, circuit board 26 and speaker 28 which are vulnerable to the vibrations are attached to the top case 3 of the body 1, the top case 3 is not put into direct contact with the string vibration parts. Thus, impact produced when the strings are touched is difficult to be directly transmitted from the string vibration parts to the non-string vibration parts to thereby operate same in a stabilized manner.

In this case, the resilient packing 30 provided between the back case side 2*b* and the top case side 3*b* prevents generation of unnecessary noise which would otherwise be caused owing to contact of the back case side 2*b* with the top case side 3*b* caused by the string vibrations.

In this guitar, the tape recorder body 23 which is a recording/reproducing device is attached to the tape recorder fixture 21 on the top 3*a* at its upper left-hand position. For example, the tape recorder body 23 is distant from any one of the rotational center of the musical instrument body 1 played on the player's knees (a right-hand recess 1*a* in the body 1 of FIG. 1) and the rotational center of the instrument body 1 hung from the player's shoulder by the strap attached to the two opposing strap fixtures 10 provided on the instrument case 1 (that is, the middle body portion between the two strap fixtures 10) when the instrument is played. Thus, even when the instrument body 1 is moved so as to turn around any one of the rotational centers of those instrument bodies 1 in the playing of the instrument 1, the tape recorder body 23 does not turn in accordance with the movement of the instrument body 1, but makes substantially linear reciprocation. Therefore, the tape recorder body 23 is unlikely to make uneven rotations to thereby ensure a stabilized operation of the tape recorder body 23.

Second Embodiment

Figure 6:
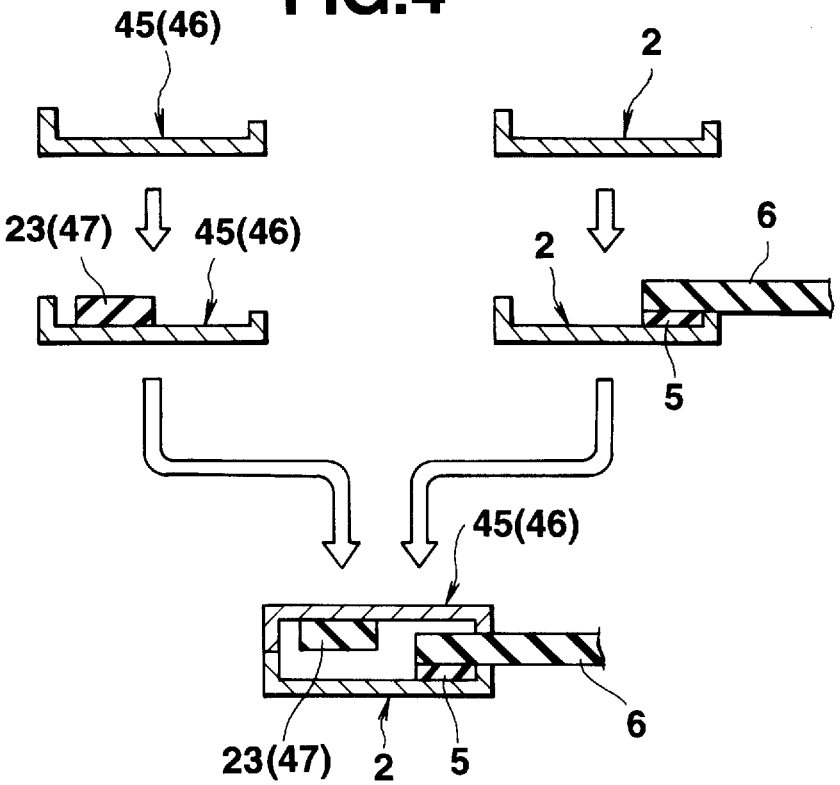
FIG. 6 illustrates a process for assembling the electronic guitar of the second embodiment.
Figure 5:
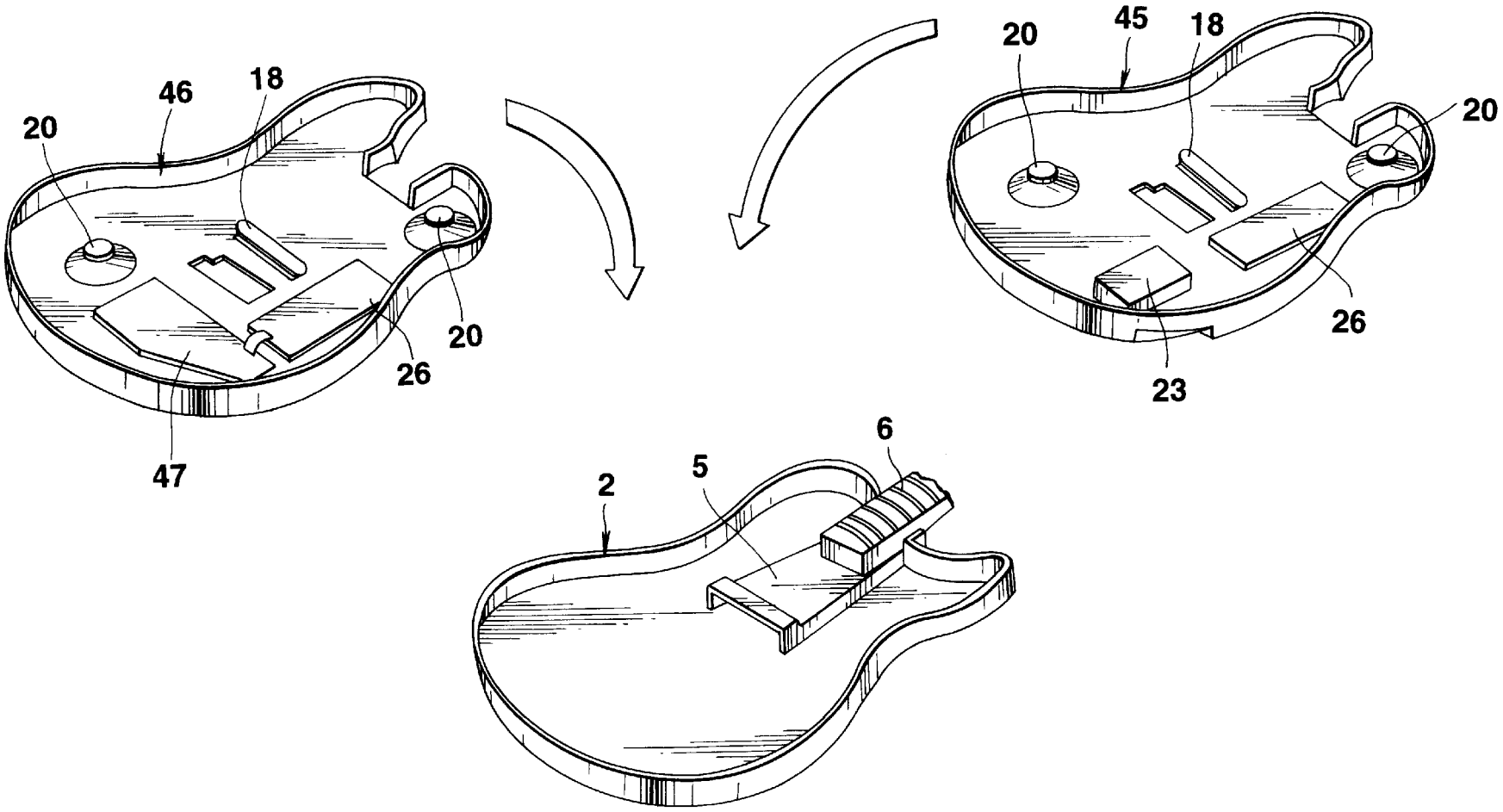
FIG. 5 shows the features of an electric guitar of a second embodiment of the present invention.

Referring to FIGS. 5 and 6, a second embodiment of the inventive stringed instrument will be described below. The same reference numeral is used to identify the same element in the second and first embodiments, and further description thereof will be omitted.

As shown in FIG. 5, the electric guitar includes a back case 2 to which string vibration parts such as a neck 6 are attached through a reinforcement 5, a first top case (second case) 45 to which non-string vibration parts such as a tape recorder body 23, a circuit board 26 and a speaker 20 which provide additional functions are attached, a second top case (a further second case) 46 to which non-string vibration parts providing functions different from the functions of the first top case 45 are attached, with any one of the first and second top cases 45 and 46 being attached replaceably to the back case 2. The first top case 45 has the same structure as that of the first embodiment and includes exactly the same non-string vibration parts as the first embodiment. The second top case 46 has substantially the same shape as the first top case 45. Attached to the second top case 46 is a rhythm sound source board 47 to which a rhythm sound source circuit (which generates and outputs a predetermined rhythm musical sound signal automatically at a predetermined tempo) which automatically performs a rhythm performance in place of the tape recorder 23 is formed. In addition, attached also to the second top case 46 as in the case of the first top case 45 are a pick-up 18, a speaker 20 and a circuit board 26. Thus, non-string vibration parts attached to the second top case 46 are different in function from the non-string vibration parts attached to the first top case 45.

As shown in FIG. 6, when such electric guitar is assembled, first, a neck 6 is attached through the reinforcement 5 to the back case 2 and the string vibration parts are attached to the back case 2. The non-vibration parts having different functions are attached to the corresponding first and second top cases 45 and 46. Thereafter, any one of the first and second top cases 45 and 46 is screwed through the same vibration absorber (not shown) as in the first embodiment to the back case 2 to thereby assemble the guitar.

When a plurality of different electric guitars having different functions is manufactured, any one of the top cases 45 and 46 to which corresponding non-string vibration parts having different functions are attached is attached to a back case 2 common to all the different guitars to thereby easily manufacture a stringed instrument having a different additional function. The use of the back case 2 common to all the kinds of guitars simplifies the manufacturing process to thereby reduce the manufacturing cost.

When the user who has an electric guitar buys only a new top case to which non-string vibration parts having a different function are attached, he is only required to exchange the old top case with the new one to thereby obtain another electric guitar having new functions.

Third Embodiment

Figure 7:
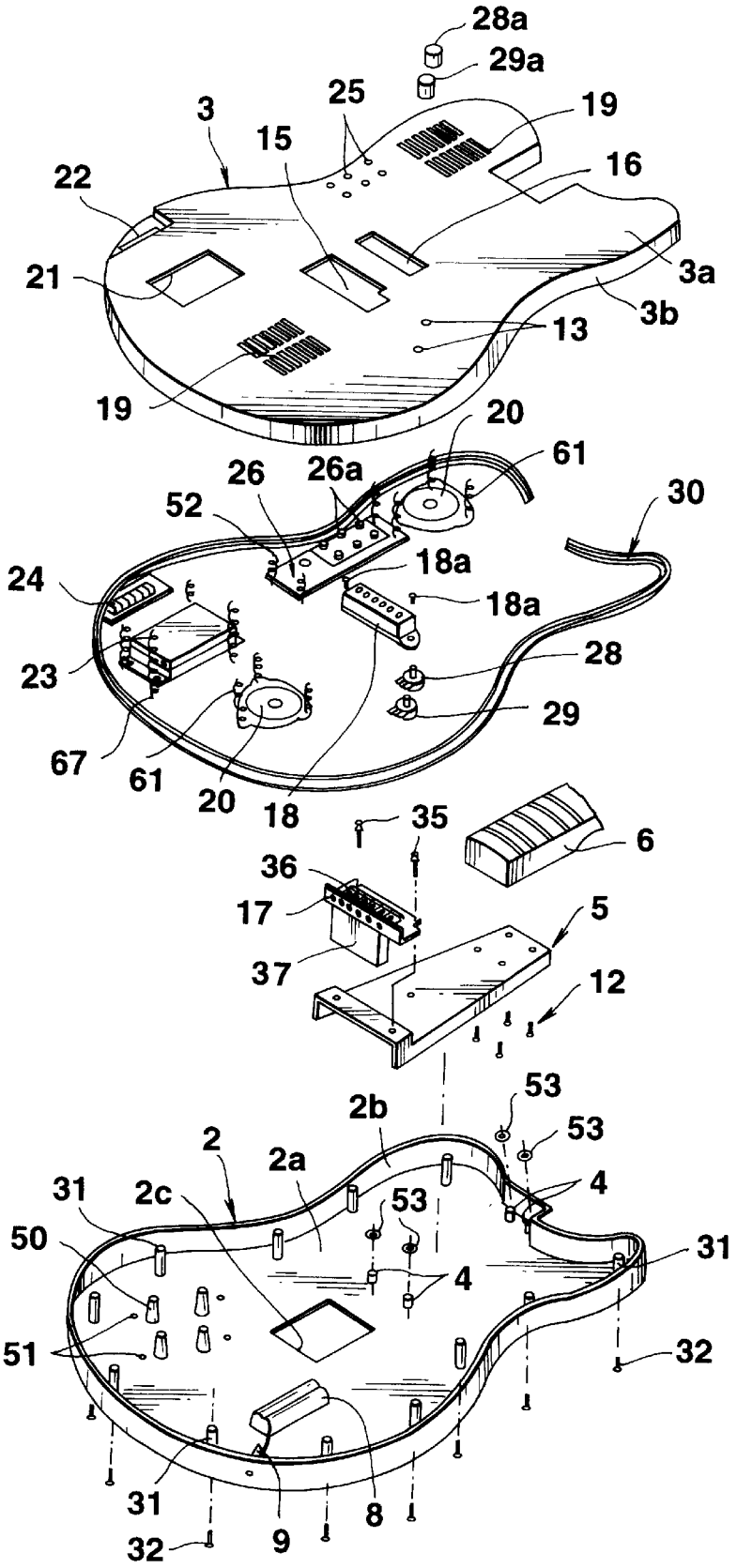
FIG. 7 is an exploded perspective view of an essential portion of an electric guitar of a third embodiment of the present invention.
Figure 8:
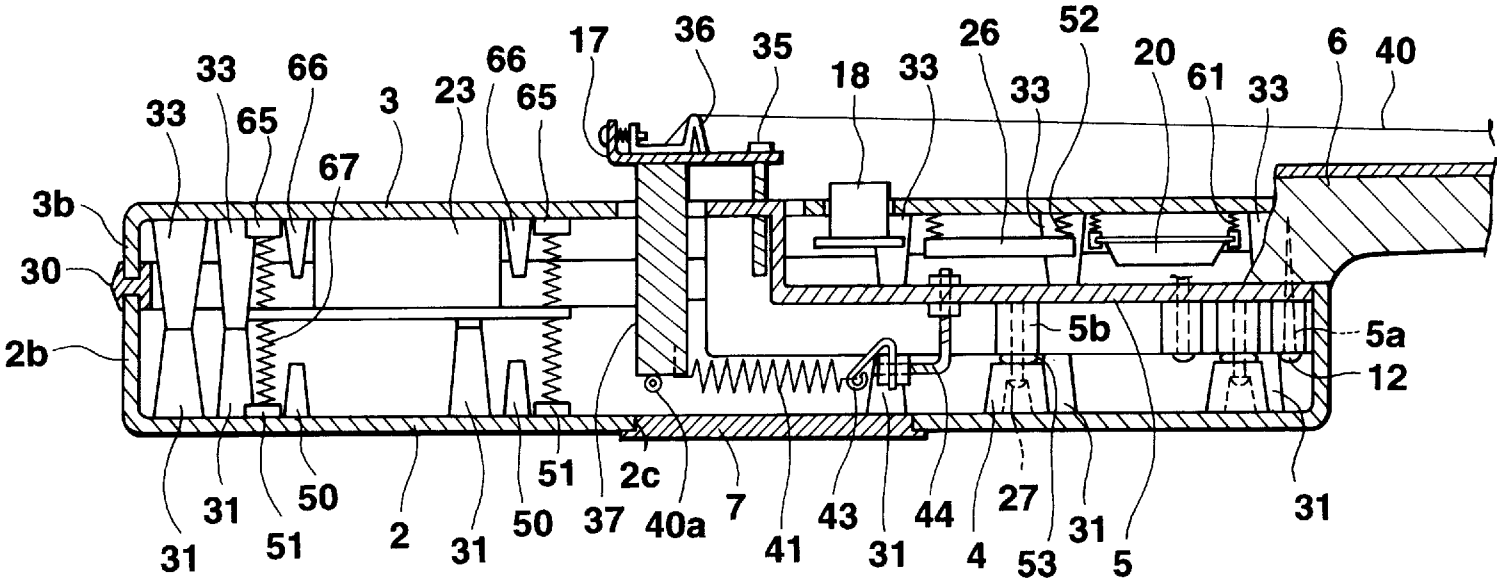
FIG. 8 is a cross-sectional view of the guitar of the third embodiment taken along a line similar to the line B—B of FIG. 1.
Figure 9:
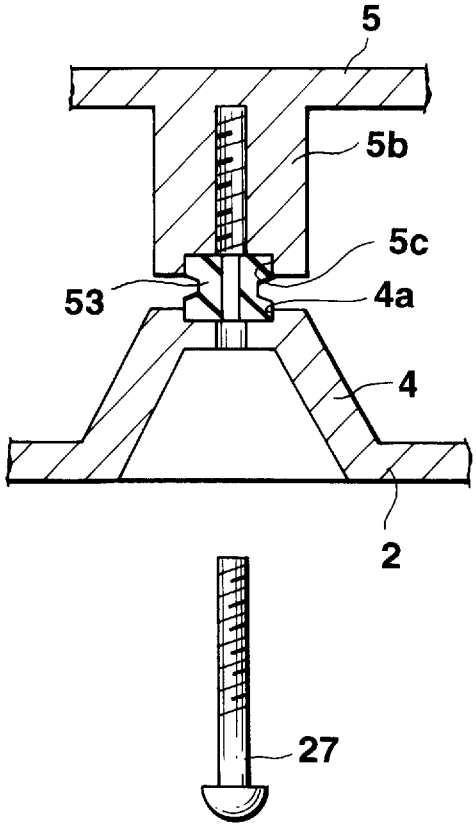
FIG. 9 is an enlarged view of a structure where a resilient bushing 53 of the guitar of the third embodiment of FIG. 8 is attached.
Figure 10:
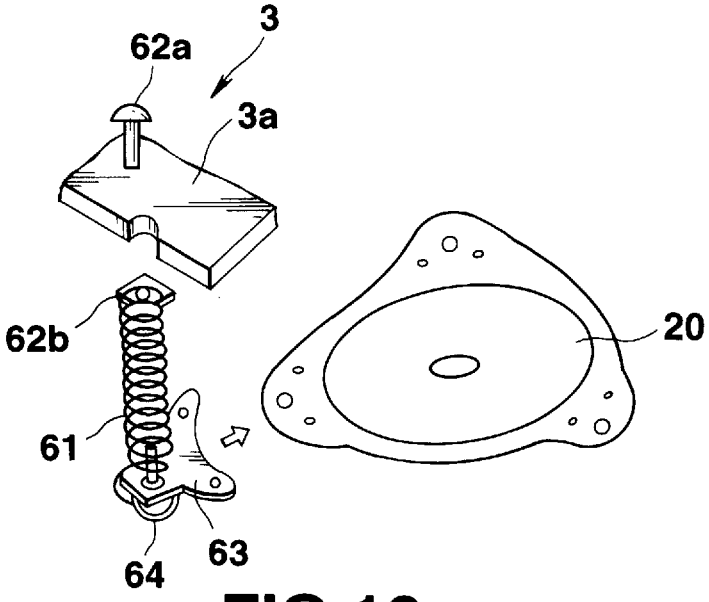
FIG. 10 is an exploded perspective view of a structure where a speaker 20 of the guitar of the third embodiment is attached.
Figure 11:
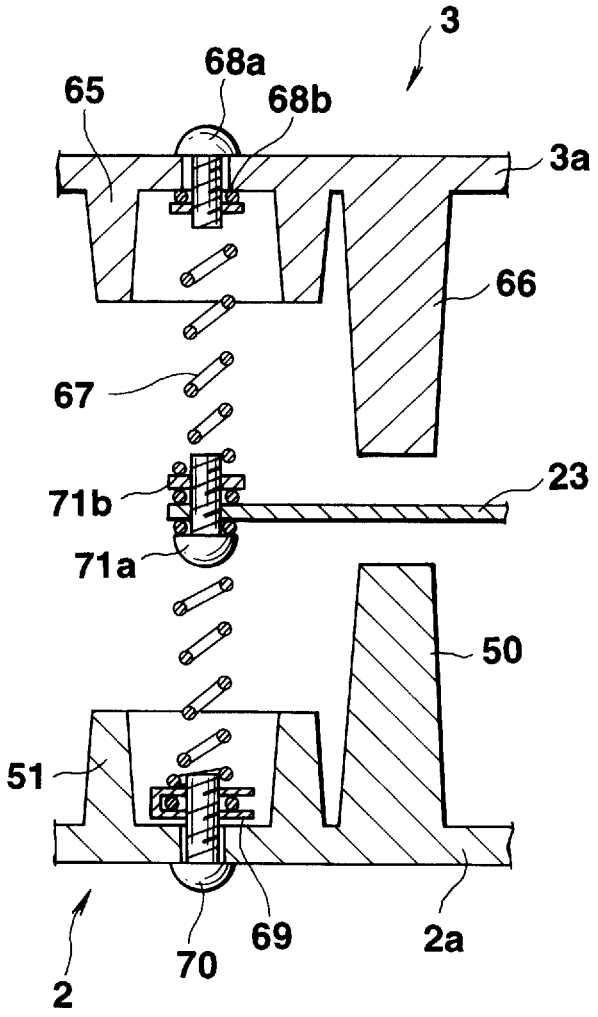
FIG. 11 is an enlarged view of a structure where a tape recorder body 23 of the guitar of the third embodiment of FIG. 8 is attached.

Referring to FIGS. 7–11, an electric guitar of a third embodiment of the present invention will be described next. FIG. 7 is an exploded perspective view of a essential portion of the electric guitar of the third embodiment. FIG. 8 is a cross-sectional view of the guitar of the third embodiment taken along a line similar to the line B—B of FIG. 1. FIG. 9 is a cross-sectional view of a fixture of a back case 2 and a reinforcement 5. FIG. 10 is an exploded perspective view of a fixture of a speaker 20. FIG. 11 is a cross-sectional view of a fixture of a tape recorder.

The basic structure of the electric guitar of this embodiment is similar to that of the first embodiment and the present embodiment has the same front view as the first embodiment. The same reference numeral is used to identify the same component of the first-third embodiments and its further description will be omitted.

As shown in FIGS. 8 and 9, a back case 2 and a reinforcement 5 are superposed with a resilient bushing 53 composed, for example, of urethane foam disposed between the attaching bosses 4 of the back case 2 and the attaching bosses 5*b* of the reinforcement 5 and fixed with screws 27 screwed through the attaching bosses 4 and the resilient bushing 53 from below the back case 2 into the attaching bosses 5*b* of the reinforcement 5. In this case, the resilient bushing 53 takes the form of a hollow cylinder and is received at its upper and lower ends in recesses 4*a* and 5*c* in upper and lower ends of the attaching bosses 4*b* and 5*b* of the back case 2 and the reinforcement 5, respectively.

Thus, string supports including a bridge base 17, bridge saddle 36, tremolo block 37 and coil spring 41; and string vibration parts including a neck 6, head 38, pegs 39 and tremolo arm 42 are attached to the reinforcement 5, which is, in turn, attached through the resilient bushing 53 to the back case 2.

A circuit board 26 which has attached effect function elements provided on the top 3*a* at its upper central position is attached through coil springs (vibration absorbers) 52 with push buttons 26*a* which select and adjust effect sounds produced by the effect function elements provided on the circuit board 26 being inserted into the corresponding push button receiving holes 25 in the top 3*a*.

The fixture of the speaker 20 will be described next with reference to FIG. 10. In FIG. 10, three coil springs (vibration absorbers) 61 (only one is shown in FIG. 10) are attached at upper ends by screws 62*a* and nuts 62*b* below the sound release holes 19, respectively, in the top 3*a* of the top case 3. Fixtures 63 are attached by screws 64 to lower ends of the three coil springs 61 and also screwed up into the outer periphery of a speaker 20 at three points. That is, the speaker 20 is attached to the top case 3 through the three coil springs 61.

The fixture of a tape recorder body 23 will be described next with reference to FIG. 11. Four annular attaching guides 65 are provided at corresponding positions along the periphery of a tape recorder opening 21 in the top 3*a* of the top case 3 in correspondence to attaching guides 51 of the back 2*a* of the back case 2. Four upstanding upper limit position restricting members 66 which restrict the upper limit position of the tape recorder body 23 are provided at predetermined positions in correspondence to lower limit position restricting members 50. Four coil springs (vibration absorbers) 67 extend between the corresponding attaching guides 65 and 51 of the top and back cases 3 and 2. The respective coil springs 67 are attached at their upper ends to the top 3*a* by screws 68*a* and nuts 68*b* and caulked at their lower ends with fixtures 69 having a U-like cross section. Screws 70 inserted into the attaching guides 51 from below the back case 2 are screwed into the screw receiving holes (not shown) in the fixtures 69 to thereby attach the coil spring 67 to the back 2*a*. In this case, since both ends of the respective coil springs 67 are disposed within the corresponding attaching guides 51, 65, the coil springs 67 are prevented from deviating in position even when they are not fixed by screws 68*a*, 70, nuts 68*b* and fixture 69. The tape recorder body 23 is attached at four predetermined positions to the corresponding substantially middle portions of the coil springs 67 with screws 71*a* and nuts 71*b*. Thus, the tape recorder body 23 is attached between the back and top cases 2 and 3 with the four coils springs 67. Both the position restricting members 50 and 66 restrict the upper and lower limit positions of the tape recorder body 23 to thereby prevent same from impinging on the top and back cases 2 and 3 and other parts.

As just described above, since in this guitar the reinforcement 5 is attached through the resilient bushing 26 to the back case 2, and the string supports including the bridge base 17 and the string vibration parts including the neck 6, head 38, pegs 39 and tremolo arm 42 are attached to the reinforcement 5, the string vibrations generated in the string vibration parts vibrate the reinforcement 5. However, the resilient bushings 53 absorb the string vibrations, and no string vibrations are transmitted to the parts including the tape recorder body 23, speaker 20 and circuit board 26 of the musical instrument body 1 which are vulnerable to the vibrations.

The parts which include the speaker 20, etc., which generates vibrations are attached through the coil springs 61 to the top case 3. Thus, the vibrations generated by the speaker 20, etc., are absorbed by the coil springs 61 to prevent the vibrations of the parts generated in the performance from being transmitted to the string vibration parts, and other parts including the tape recorder body 23 and circuit board 26 to thereby prevent the vibrations of the strings 40 and the non-string vibration parts from being adversely affected.

Since the parts including the tape recorder body 23 and the circuit board 26 which are vulnerable to the vibrations are attached through the coil springs 67, 52 to the top case 3, the spring vibrations and other vibrations generated by the vibration generation parts including the speaker 20, etc., are absorbed by the coil springs 67, 52 to thereby prevent those vibrations from being transmitted to the parts vulnerable to the vibrations.

While in the present embodiment the reinforcement 5 is attached through the resilient bushing 53 to the back case 2, the present invention is not limited to this embodiment. For example, the reinforcement 5 may be attached, for example, through coil springs, in place of the resilient bushings.

While in the embodiment the tape recorder body 23, speaker 20 and circuit board 26 are illustrated as attached through the coil springs 67, 61, 52 to the top case 3, the present invention is not limited to this embodiment. They may be attached, for example, through resilient bushings.

Fourth Embodiment

Referring to FIGS. 12–15, an electric guitar of a fourth embodiment of the inventive guitar will be described next. The basic structure of the fourth embodiment is similar to the first-third embodiments. The same reference numeral is used to denote the same component of the first-fourth embodiments and further description thereof will be omitted as required.

Figure 12:
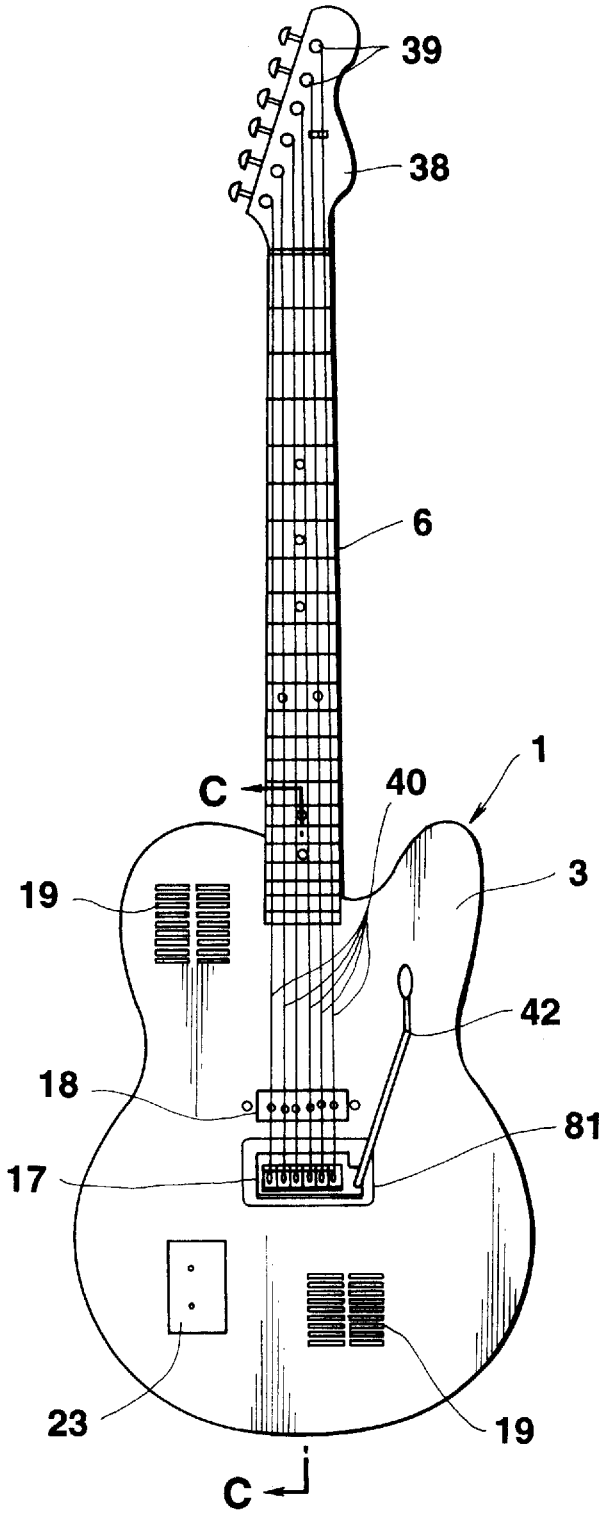
FIG. 12 is a front view of an electric guitar of a fourth embodiment of the present invention.
Figure 13:
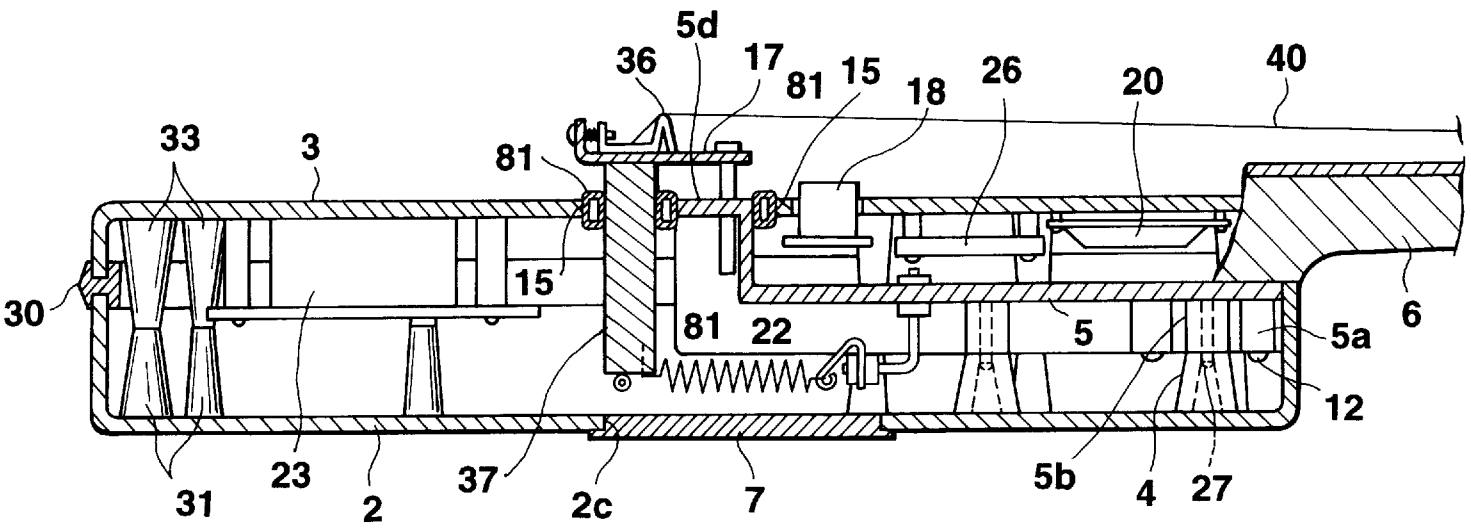
FIG. 13 is a cross-sectional view taken along the line C—C of FIG. 12.
Figure 14:
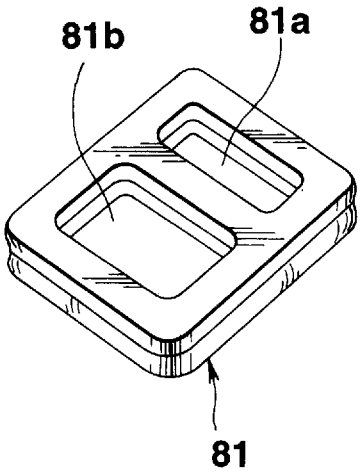
FIG. 14 is a perspective view of a hiding member 81 of the guitar of the fourth embodiment.
Figure 15:
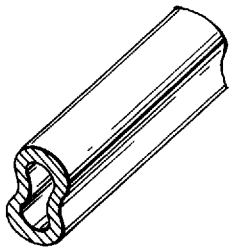
FIG. 15 is a perspective cross-sectional view of the hiding member 81.

FIG. 12 is a front view of the electric guitar of the fourth embodiment. FIG. 13 is a cross-sectional view of an essential portion of the guitar. FIG. 14 is a perspective view of a hiding member 81 of the guitar of the fourth embodiment. FIG. 15 is a perspective cross-sectional view of the hiding member 81.

A tremolo block 37 and a bridge fixture 5*d* of a reinforcement 5 are disposed in an opening 15 in a top case 3 so that a predetermined spacing is formed around each of the tremolo block 37 and the bridge fixture 5*d* to thereby prevent the bridge fixture 5*d*, tremolo block 37 and the top case 3 from receiving their mutual vibrations. A hiding member 81 is fitted snugly into in the opening 15 so as to cover each spacing. The hiding member 81 is made of a pipe-like resilient member (FIG. 15), for example, of urethane foam and takes the form of an 8, as shown in FIG. 14. The resilient hiding member 81 resiliently receives the bridge fixture 5*d* of the reinforcement 5 in an opening 81*b* thereof, and the tremolo block 37 in an opening 81*a* thereof. Thus, the respective spacings are hidden completely by the hiding member 81 to thereby provide good appearance. No dust will enter the spacings. The top case 3, bridge fixture 5*d* and tremolo block 37 are protected from the influence of the mutual vibrations.

Fifth Embodiment

Figure 16:
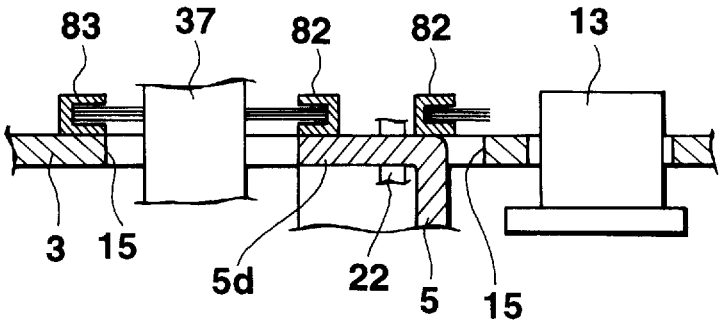
FIG. 16 is a cross-sectional view of an essential portion of an electric guitar of a fifth embodiment of the present invention.
Figure 17:
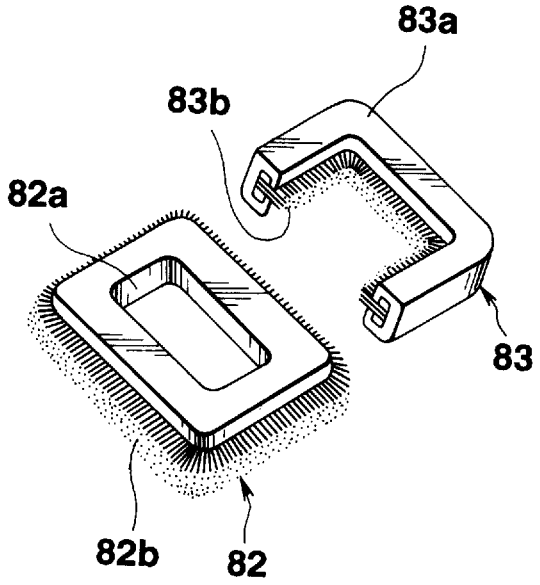
FIG. 17 is a perspective view of hiding members 82 and 83 of the electric guitar of the fifth embodiment.
Figure 18:
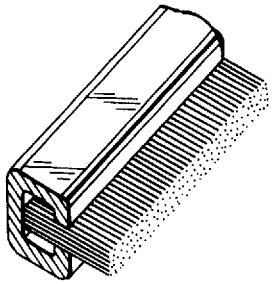
FIG. 18 is a perspective cross-sectional view of the hiding members 82 and 83 of FIG. 17.

Referring to FIGS. 16–18, a fifth embodiment of the inventive electric guitar will be described. The same reference numeral is used to identify the same component of the fifth and fourth embodiments and further description thereof will be omitted.

FIG. 16 is a cross-sectional view of an essential portion of the fifth embodiment of the electric guitar. FIG. 17 shows hiding members 82 and 83 of the electric guitar of the fifth embodiment. FIG. 18 is a perspective cross-sectional view of each of the hiding members 82 and 83.

First and second hiding members 82, 83 are provided respectively on the bridge fixture 5*d* of the reinforcement 5 received in the opening 15 in the top case 2, and along that part of the inner periphery of the opening 15 facing the opposite side of the tremolo block 37 from the first hiding member 82. The first hiding member 82 is composed of a substantially O-like fixture 82*a* having substantially the same extension as the bridge fixture 5*d* and bristles 82*b* extending outward from the outer side wall of the fixture 82*a* so as to substantially cover the spacing between the inner periphery of the opening 15 and the bridge fixture 5*d* received in the opening 15 and the spacing between the bridge fixture 5*d* and the tremolo block 37. The second hiding member 83 is composed of a substantially U-like fixture 83*a* and bristles 83*b* extending from the inner side wall of the fixture 83*a* to substantially the outer periphery of the tremolo block 37. Thus, the respective spacings are hidden well by the bristles to thereby provide good appearance and to reduce dust which would otherwise enter the spacings. In addition, the top case 2, bridge fixture 5*d* and tremolo block 37 are prevented from being influenced from mutual vibrations.

Sixth Embodiment

Figure 19:
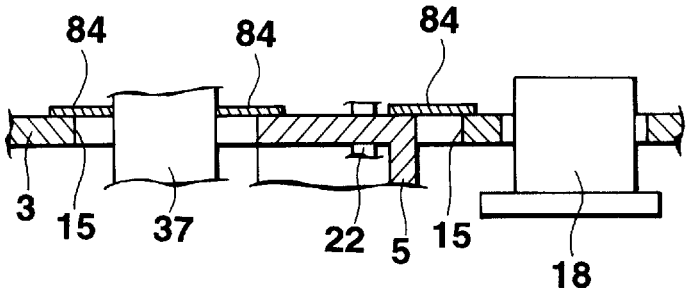
FIG 19 is a cross-sectional view of an essential portion of an electric guitar of a sixth embodiment of the present invention.
Figure 20:
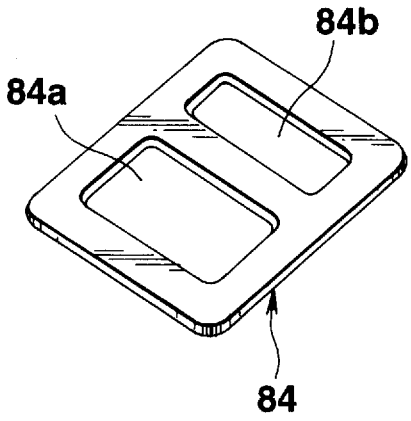
FIG. 20 is a perspective view of a hiding member 84 of the guitar of the sixth embodiment.

Referring to FIGS. 19 and 20, a sixth embodiment of the inventive stringed instrument will be described. Also, in this case, the same reference numeral is used to identify the same component of the first-sixth embodiments, and further description thereof will be omitted.

FIG. 19 is a cross-sectional view of an essential portion of an electric guitar of the sixth embodiment. FIG. 20 is a perspective view of a hiding member 84 of the guitar of the sixth embodiment.

The hiding member 84 which covers a spacing produced around each of a bridge fixture 5*d* and a tremolo block 37 disposed in an opening 15 in the top case 2 is bonded to the top case 2. The hiding member 84 is a sheet-like member of an non-woven fabric and takes substantially the form of an 8 with its first and second openings 84*a* and 84*b* which expose the middle portion of the bridge fixture 5*d* of the reinforcement 5 and fit over the tremolo block 37, respectively, as shown in FIG. 20. Thus, the spacings are hidden completely to thereby provide good appearance and no dust enters through the spacing. In addition, the top case 2, bridge fixture 5*d* and the tremolo block 37 are prevented from being influenced by mutual vibrations.

The quality and shape of the hiding members are not limited to the ones shown above and are only required not to transmit the string vibrations to the top case 2. Even a stringed instrument which has no tremolo block 37 is only required to be constructed so that the hiding members hide the opening 15.

Seventh Embodiment

A seventh embodiment of the inventive electric guitar will be described with reference to FIGS. 21 and 22.

Figure 21:
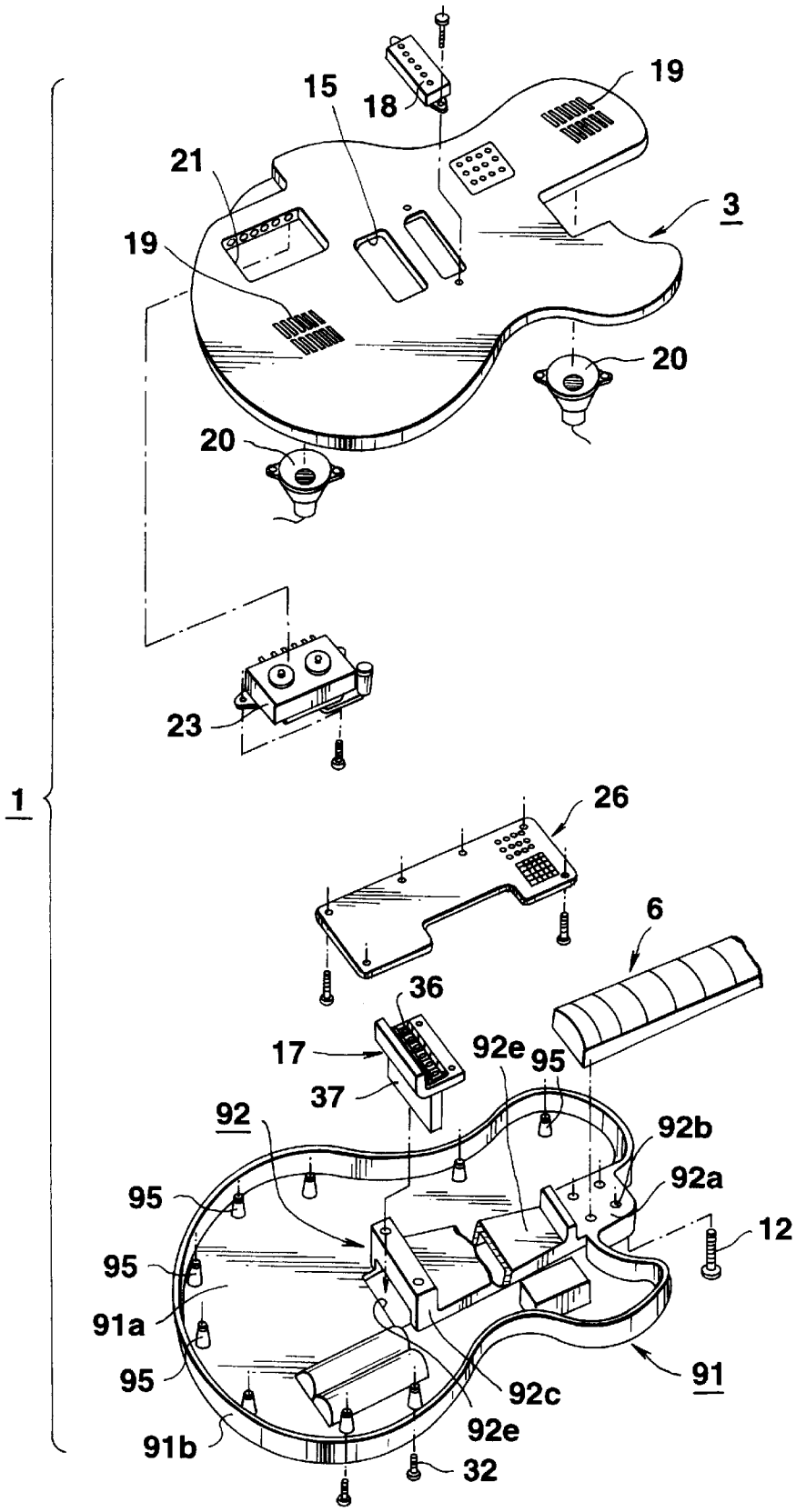
FIG. 21 is an exploded perspective view of an essential portion of an electric guitar of a seventh embodiment of the present invention.

FIG. 21 is an exploded perspective view of an essential portion of the guitar of the seventh embodiment. FIG. 22 is a cross-sectional view of the guitar of the seventh embodiment taken along a line similar to the line B—B of FIG. 1. The same reference numeral is used to identify the same component of the first-seventh embodiments and further description thereof will be omitted.

In the electric guitar of the present embodiment, a long neck 6 is connected to a body 1, which is composed of a back case 91 and a top case 3 with the latter being, for example, made of a synthetic resin. The back case 91 is composed, for example, of an aluminum die-casting and has required rigidity. The back case 91 has a side wall 91*b* upstanding integrally from its bottom 91*a*. The top case 3 is aligned with and joined to the back case 91 at their peripheries so as to cover the back case 91 with screws 32 inserted into screw receiving bosses 95 provided on an upper surface of the bottom 91*a* of the back case 91 tightening the screw receiving bosses 95 and attaching bosses 33 provided on a lower surface of the top 3*a* to thereby form a hollow body 1.

As will be obvious in FIG. 21, one of the features of the invention is to combine not the top case 3 but the neck 6 with the back case 91. The back case 91 to which the neck 6 is attached has a reinforcement 92 integral therewith substantially protruding into the body. The reinforcement 92 takes the form of a substantially U-like cross section extending longitudinally of the neck 6. The reinforcement 92 is fixed at its front neck fixture 92*a* to the base of the neck 6 and at the rear bridge fixture 92*c* to the bridge base 17. The substantially U-like cross section of the reinforcement 92 serves to reduce its weight which would otherwise increase. In this embodiment, the front neck fixture 92*a* has four neck attaching bosses 92*f* therebelow and having screw receiving holes 92*b* extending through the bosses 92*f* therein. As shown in FIG. 22 which is a side cross-sectional view, the neck 6 is attached at its base to the reinforcement 92 with four screws 31 screwed into the attaching bosses 92*b* from below. The reinforcement 92 having a U-like cross section may have reinforcing ribs on its lower surface to increase its rigidity. An opening 92*e* is formed in the bottom 91*a* near the rear end of the reinforcement 92 and the rear end of the reinforcement 92 is recessed for the maintenance including exchange of the strings.

Figure 22:
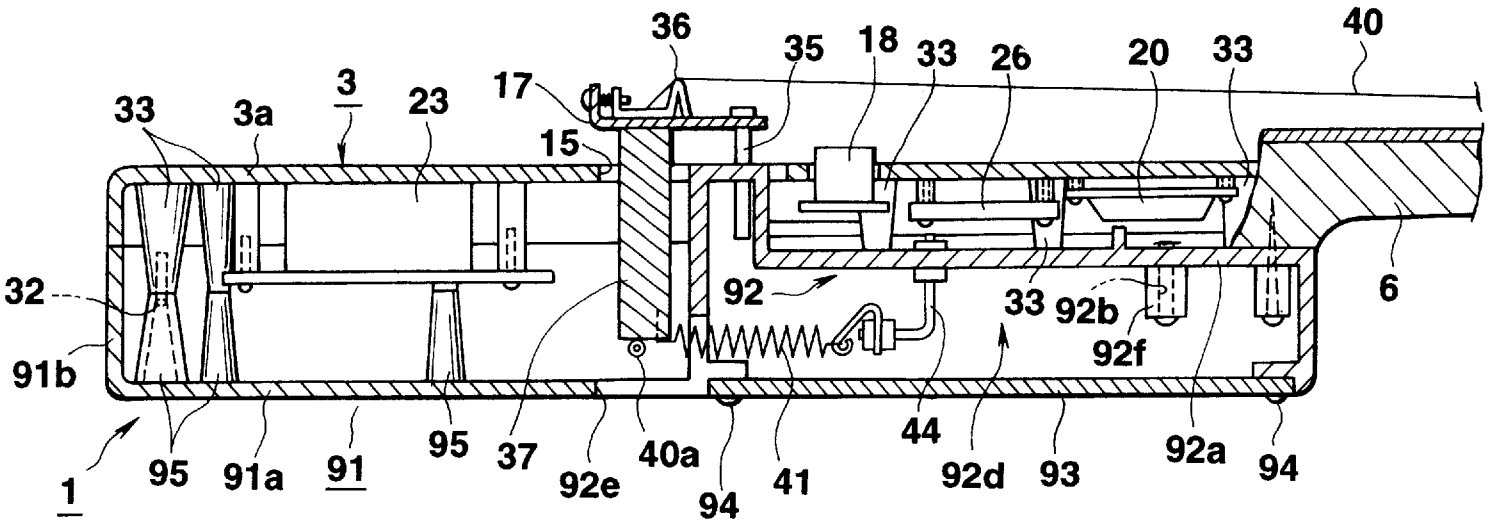
FIG. 22 is a cross-sectional view of the guitar of the seventh embodiment taken along a line similar to the line B—B of FIG. 1.

As shown in FIG. 22, the bottom 3 of the back body 2 has an opening cover 93, which is removably fitted into a bottom opening and tightened with screws 94 against the bottom 91*a*.

Thus, as will be obvious from the seventh embodiment, the neck 6 is connected to the back case 91 which has the reinforcement 92 integral therewith for increasing its rigidity. Compared to fasting the reinforcement and back case with screws, integral molding of the reinforcement 92 and the back case 91 serves to improve the sound quality and reduces the number of parts used. High-accuracy positioning and the use of a jig in the manufacturing process are not required to thereby reduce the manufacturing cost. In addition, uneven assembling accuracies are minimized to provide articles of a given quality and to hence facilitate quality management, advantageously.

While in the first-seventh embodiments the stringed instruments using a tape recorder and a rhythm sound source as the non-string vibration parts which provide the additional functions have been described, the present invention is not limited to the particular embodiments. For example, the stringed instrument may use a liquid crystal display, a liquid crystal television set, a sound source unit, a frequency extracting unit, a tuning meter, a mini-disk recorder, a digital compact cassette recorder, a compact disk player, a digital audio tape recorder, a multi-track tape recorder, a sequencer and other parts may be used.

While in the embodiments the application of the invention to the electric guitar has been described, the present invention is not limited to the particular cases. For example, the invention is applicable widely to stringed instruments such as violins and cellos.

While several preferred embodiments of the present invention have been described in detail, they are only for illustrative purposes and the present invention is carried out in various forms. That is, various changes and modifications are possible without departing from the spirit and scope of the present invention defined in the appended claims. Thus, the scope of the present invention should be determined from the appended claims and their equivalents.

What is claimed is:

1. A stringed instrument comprising:

a hollow body comprising a top and a back formed as separate parts and which, when assembled to each other in the stringed instrument, partially define a hollow therein;

a string vibration part attached to a reinforcement member of high rigidity, the reinforcement member being attached to one of the top and back;

a non-string vibration part being attached to the other of the top and back; and an impact absorber positioned between respective contact surfaces of the top and back to separate the top and the back parts from each other when assembled in the stringed instrument for absorbing impact produced by the string vibration part to prevent the impact from being transmitted via said contact surfaces to the non-string vibration part.

2. A stringed instrument according to claim 1, wherein the string vibration part comprises a string support and a neck.

3. A stringed instrument according to claim 2, wherein the string support and the neck are attached through said reinforcement member of high rigidity to said one of the top and back of the body.

4. A stringed instrument according to claim 2, wherein the top has an opening therein; and the string support is attached to the back via the reinforcement member so as to be exposed to the outside through the opening in the top.

5. A stringed instrument comprising:

a hollow body comprising a top case and a back case formed of separate parts and which, when assembled to each other in the stringed instrument, partially define a hollow therein;

a string vibration part attached to a reinforcement member of high rigidity, the reinforcement member being attached to one of the top and back cases;

a non-string vibration part being attached to the other of the top and back cases; and an impact absorber positioned between respective contact surfaces of the top and back cases to separate the top and the back cases from each other when assembled in the stringed instrument for absorbing impact produced by the string vibration part to prevent the impact from being transmitted via said contact surfaces to the non-string vibration part.

6. A stringed instrument according to claim 5, wherein the string vibration part comprises a string support and a neck.

7. A stringed instrument according to claim 6, wherein the string support and the neck are attached through said reinforcement member of high rigidity to said one of the top case and back case of the body.

8. A stringed instrument according to claim 6, wherein the top case has an opening therein: and the string support is attached to the case via the reinforcement member so as to be exposed to the outside through the opening in the top case.

9. A stringed instrument according to claim 5, further comprising means for permitting replacement of the top case with another top case to which another non-string vibration part having a different function is attached.

* * * * *